United States Patent [19]

Maupate

[11] 4,291,910

[45] Sep. 29, 1981

[54] DISAPPEARING GRASPING HEAD

[75] Inventor: Jacques Maupaté, Givry, France

[73] Assignee: Societe Generale Pour l'Emballage, France

[21] Appl. No.: 106,038

[22] Filed: Dec. 21, 1979

[30] Foreign Application Priority Data

Dec. 22, 1978 [FR] France ..... 78 36190

[51] Int. Cl.[3] ..... B66C 1/54

[52] U.S. Cl. ..... 294/95; 294/96

[58] Field of Search ..... 294/86.14, 86.24, 86.25, 294/86.29, 86.3, 86 A, 93-96, 97, 100, 110 R, 115, 116; 198/694, 696; 414/416, 753

[56] References Cited

U.S. PATENT DOCUMENTS

| | | | |
|---|---|---|---|
| 3,722,710 | 3/1973 | Ixer et al. | 294/95 X |
| 3,863,753 | 2/1975 | Shank | 294/116 X |
| 3,944,058 | 3/1976 | Strauss | 294/116 X |
| 4,154,350 | 5/1979 | Frohn | 294/95 X |

FOREIGN PATENT DOCUMENTS

| | | | |
|---|---|---|---|
| 1103229 | 3/1961 | Fed. Rep. of Germany . | |
| 1135656 | 5/1957 | France | 294/94 |
| 2315323 | 1/1977 | France . | |
| 630193 | 11/1978 | U.S.S.R. | 294/95 |

*Primary Examiner*—Johnny D. Cherry

*Attorney, Agent, or Firm*—Pennie & Edmonds

[57] ABSTRACT

Apparatus is described for grasping hollow bodies, such as bottles, from the inside. It is particularly useful in protecting grasping equipment used in conjunction with bottle coating equipment. On a movable rod inside a housing are mounted a structure adapted to engage the rim of the bottle and grasping arms which can be inserted into the neck of the bottle. The rod is spring-biased toward a position in which the structure and the grasping arms are retained within the housing. To grasp a bottle, a force is applied to the rod against this spring-bias so as to urge the rod, the structure and the grasping arms toward the bottle. At an intermediate point on the outward stroke, the structure is released from the rod. If the structure engages the rim of the bottle after its release and before the outward stroke ends, the structure is prevented by a slider from moving back into the housing and relative movement between the rod and the structure causes the grasping arms to engage the inside of the bottle. If, however, no bottle is present, the structure is resecured to the rod toward the end of its outward stroke and on the return stroke of the rod the structure is returned to within the housing. As a result, the grasping arms and rim engaging structure do not remain outside the housing and are not coated with the coating when a bottle is not present.

32 Claims, 8 Drawing Figures

DISAPPEARING GRASPING HEAD

Figure 1:
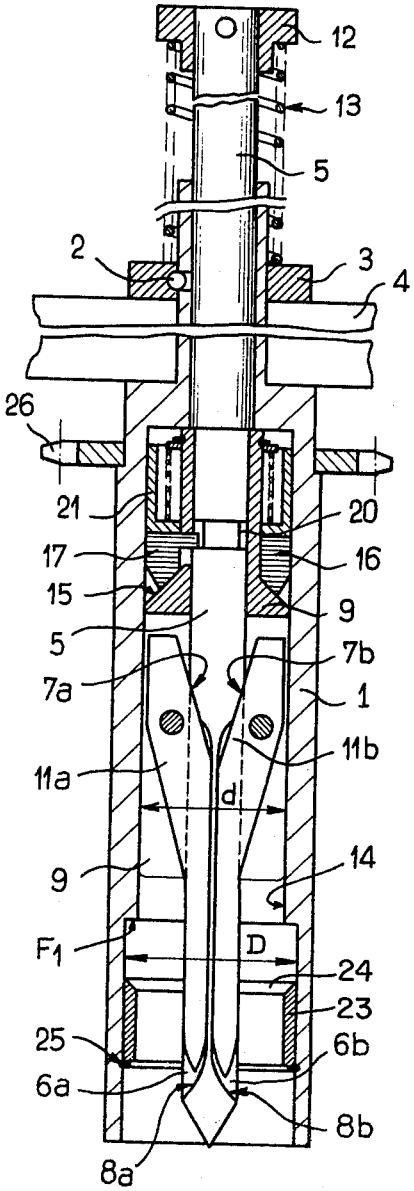

The present invention relates to the grasping of hollow bodies such as bottles, flasks, jars, pots, pipes, etc. It relates in particular to a new device for the grasping of such hollow bodies, particularly glass or plastic containers, and their transfer to a surface treatment area at the end of the manufacturing process.

During the manufacture of hollow glass containers, for instance, different treatments may be applied to them. Thus, they may undergo a treatment which increases the hardness of the glass surface by applying a metal oxide coating: this is the "hot" treatment. They may also undergo a treatment which increases or at least maintains their mechanical characteristics by means of a coating of lubricant: this is the "cold" treatment. They may finally be coated with a multiple-function layer of plastic, with this layer in particular giving shock protection, retaining chips, increasing resistance to internal pressure, perhaps giving a better appearance to the coated containers and also reducing noise during subsequent handling.

Such a treatment consisting of the application of a plastic coating is described, for example, in French Pat. No. 2,315,323. This treatment is applied in an area in which each container, picked up first by a grasping device, is carried by an overhead conveyor.

Among these grasping devices, devices are known which are equipped with clamps acting on the outside of the neck of the container. In this case it is not possible to apply a coating to the neck.

In order to eliminate this problem, grasping devices have been suggested that are equipped with clamps which enter into the opening of the container and are applied to the inside of the neck. In this case the container can be completely coated.

However, another problem persists. In the loading station upstream of the treatment area each grasping device must arrive opposite one of the containers which are spaced at uniform intervals on a conveyor. There the clamps of the grasping device enter into the opening of the container in order to grasp it and both together then move to the treatment area. But if a container is accidentally dropped and is missing on the conveyor, then the grasping device which had been intended for it goes through its cycle without being loaded. When it arrives at the treatment area, the clamps which are not protected by the container are coated with the treatment product which encrusts them in such a manner that their operation may be interfered with. In addition, when the grasping device in question returns to the loading staion after having gone through a complete cycle, its clamps deposit coating product in another container when they enter it. This product may affect the taste of the future contents of the container.

The invention proposes a grasping device for hollow bodies which eliminates these disadvantages.

This grasping device comprises a mechanism which enters the hollow body in order to grasp it without making contact with the outside of the hollow body and which, in the rest position, i.e. when it is not loaded, is completely hidden in a housing.

In one of the embodiments of the invention, the device comprises:

a housing a mechanism which is capable of entering the hollow body, equipped with clamping means which can act on the inside wall of the hollow body and which, in the rest position, is completely hidden in the housing, means acting on the entering mechanism to withdraw it from the housing, means which actuate the clamping means of said entering mechanism if the entering mechanism does not complete its stroke and stop it from rising again by locking it in an intermediate position, means which, when the entering mechanism goes through a complete stroke, return it to the housing.

The entering mechanism equipped with clamping means may be a clamp comprising two arms articulated on a shaft and capable of being made to approach each other by pivoting on said shaft so that they can enter the opening in the hollow body, and then to be spread in order to be applied firmly to the inner walls of the opening.

In one embodiment of the device, the clamp comprises two arms articulated on two parallel shafts on a rigid frame, between which arms there is placed a rod comprising on the side toward the end of the clamp which is intended to enter the hollow body an extension with sides which are inclined symmetrically in relation to the axis of the rod, with the corresponding ends of the arms having a section with a corresponding profile which makes contact with said sides in such a manner that when the rod moves longitudinally between the arms, said extension causes, by acting on these arms like a wedge, spreading of said arms inside the hollow body by pivoting around their shaft.

On the side of the rear end of the arms the rod may comprise a second extension with inclined sides which is capable of making contact with a part of the rear end of the arms in order to close these arms and keep them in the closed position.

An elastic return means can also be substituted for this closing means.

The clamping means may also consist of a sleeve consisting of several segments held together by return springs, which sections are spread out by the action of a rod or shaft comprising one or several extensions with conical sides.

In one embodiment of the invention the device comprises—a housing which can completely conceal: a rod,—a slider,—clamping means,—with the rod and the slider being able to slide inside the housing so that they can emerge from or reenter said housing,—means for alternately locking the slider to the rod or the housing, depending on the position of the slider and the rod in relation to the housing, with the slider being locked to the rod at the start and the end of the outward stroke of the rod, while it is locked to the housing in the intermediate position, in which case the rod, after being released, can describe a movement with respect to the slider and actuate, when it reenters the housing, the clamping means,—means which, when the rod and the slider go through a complete outward stroke, keep the slider and the rod locked to each other during the entire return stroke into the housing. The device also comprises means which tend to return the clamp and the slider into the housing at all times.

The means which lock the slider alternately to the rod and the housing may comprise a finger mounted on the slider which due to the action of a spring makes contact alternately with the rod and the housing.

The clamping means may be mounted on the slider. They may then comprise arms which are articulated on the slider and which spread when the rod moves in relation to the slider during the return stroke. These clamping means may also be mounted on a shaft attached to the lower end of the rod. They may then comprise a sleeve formed by at least two segments held between two conical surfaces, which surfaces may be the end of the shaft and a ring, with the segments spreading when the rod moves in relation to the slider.

Figure 2:
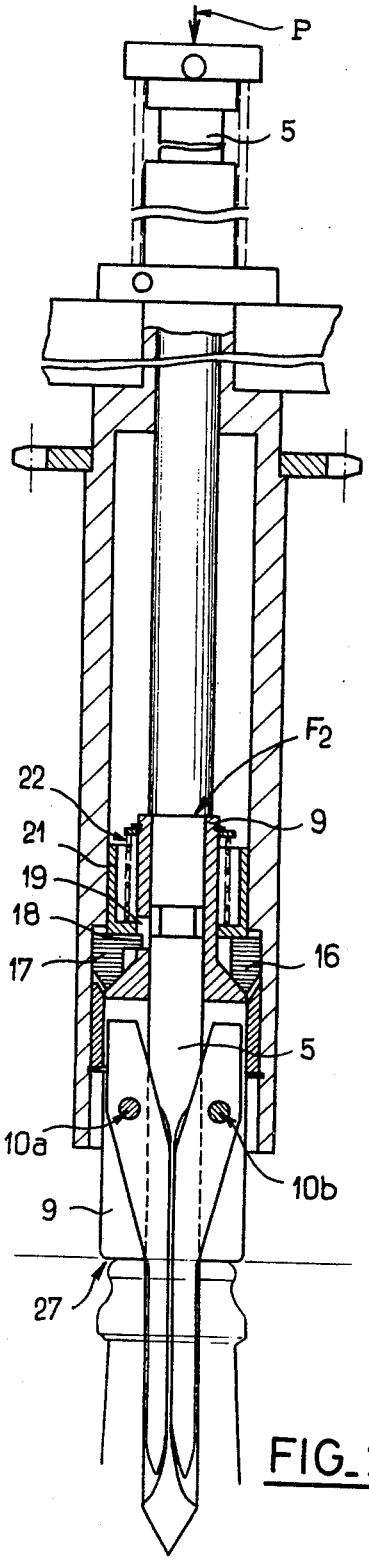
Figure 3:
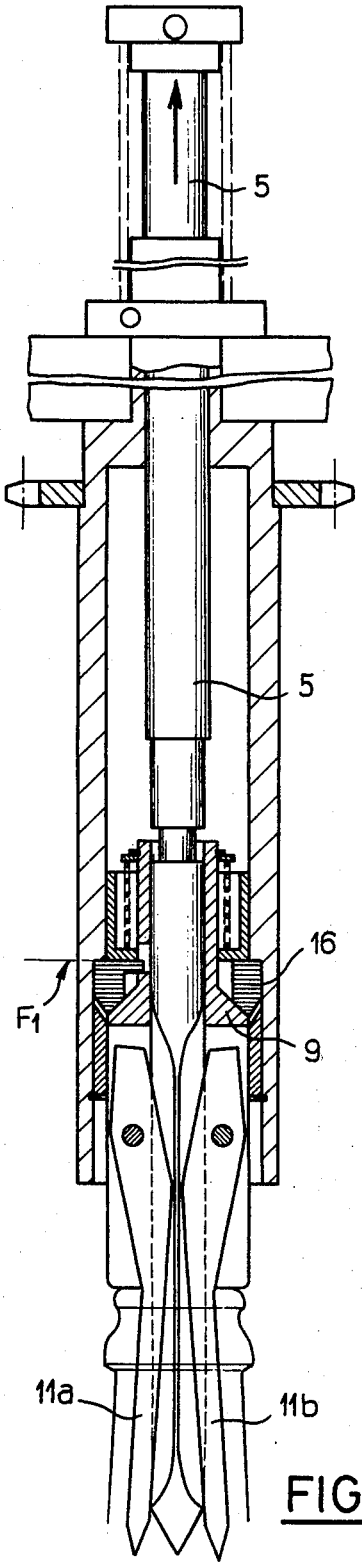
Figure 4:
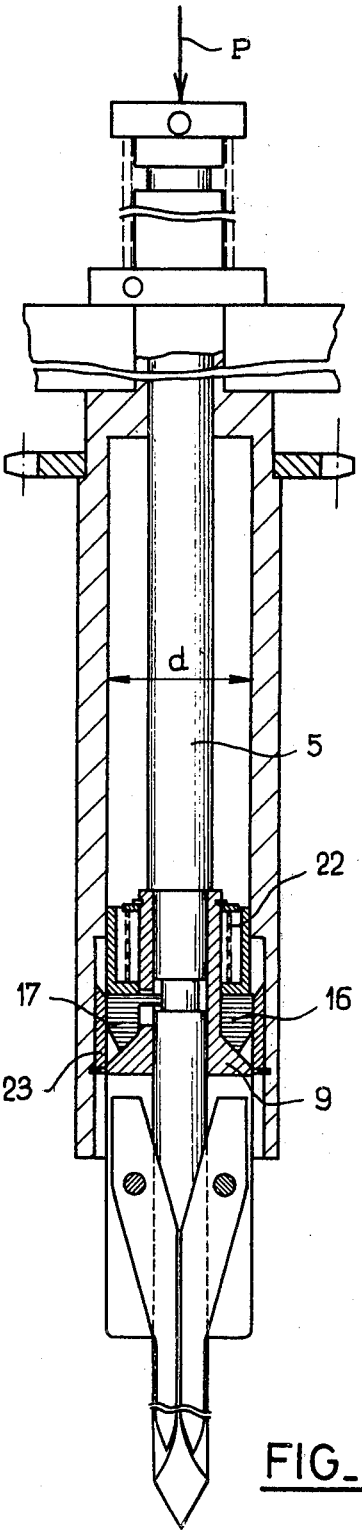
Figure 5:
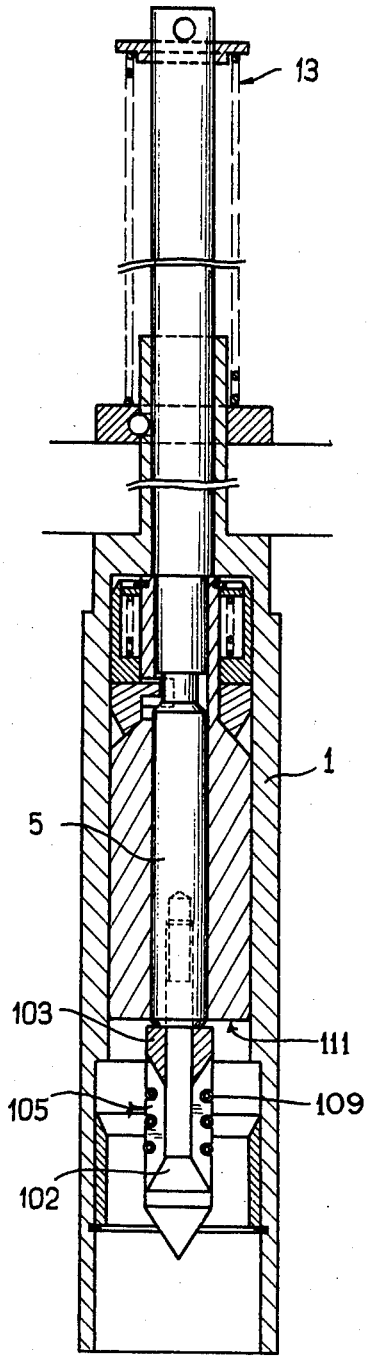
Figure 6:
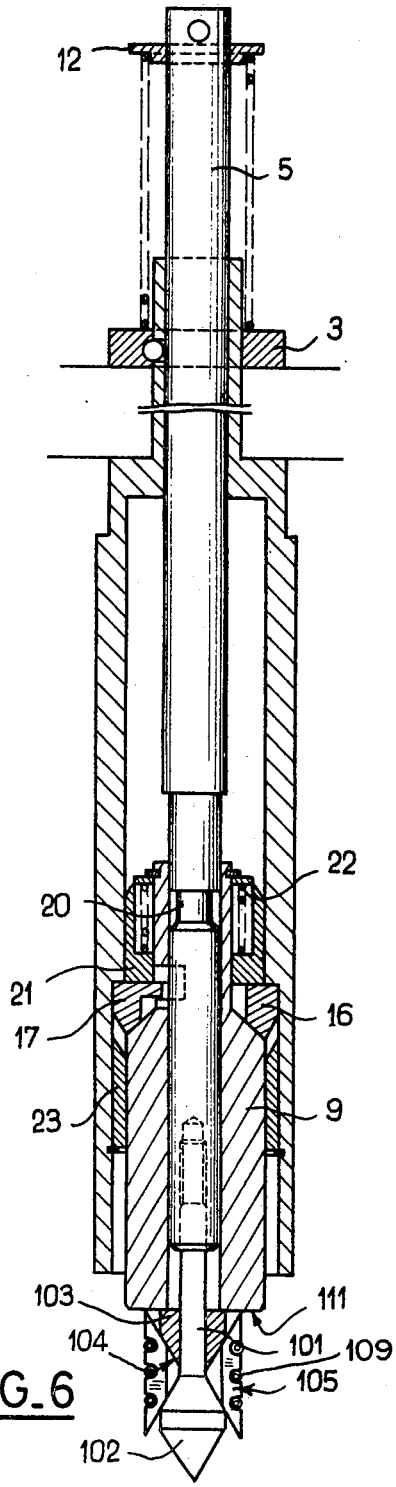
Figure 7:
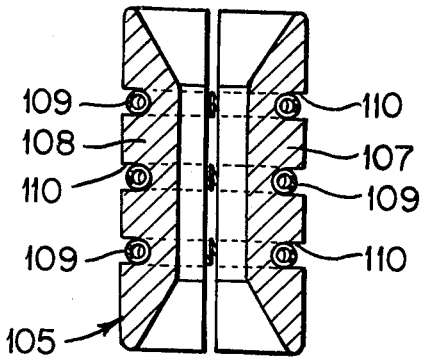
Figure 8:
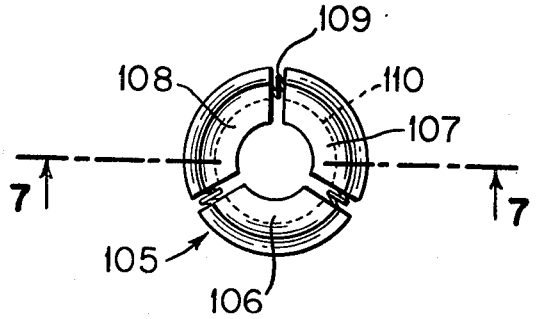

Other advantages and characteristics of the invention will be discussed in the following description of [several] embodiments, which refers to the drawings:

FIG. 1 is an elevation of the grasping device in the rest position,

FIG. 2 is a similar view of the device in the presence of a hollow body at the loading station, FIG. 3 is a similar view of the device in the presence of a hollow body, at the exit from the loading station, FIG. 4 is a similar view of the device in the absence of a hollow body, FIG. 5 is an elevation of a different embodiment in the rest position, FIG. 6 is a similar view of this embodiment in the working position, FIGS. 7 and 8 show a detail of the second embodiment of the device.

In FIG. 1 the device is shown in the rest position. It comprises housing 1 to which, by means of pin 2, is attached collar 3 by means of which housing 1 sits on element 4 of an endless chain. The housing carries sliding rod 5 whose lower part contains two grooves 6*a* and 6*b* which end, at both ends, in the inclined sides 7*a* and 7*b* and 8*a* and 8*b*, respectively. The rod is surrounded by a hollow slider 9 which carries two arms 11*a* and 11*b* which are articulated on two shafts 10*a* and 10*b* and engage the grooves in the rod. One part of the profile of the arms makes contact with the inclined sides 8*a* and 8*b* while a part of the profile of the ends makes contact with the inclined sides 7*a* and 7*b* of the grooves.

At its upper end rod 5 carries washer 12 and is pushed upwards by spring 13 placed between said washer and collar 3.

The bore of the widened part of the housing has two sections which are separated by shoulder $F_1$: a first section with a diameter d and a second section with a larger diameter D.

The middle part of rod 5 can slide in slider 9 which in turn slides inside bore 14 of section d of the housing. Said slider 9 has conical sides 15 on which slides crown 16 divided into three segments, one of which, 17, carries at its center a finger 18 passing through a hole 19 in slider 9 and engages groove 20 in rod 5 which latter it locks in place. Ring 21 is located above crown 16 against which it is pressed by the action of spring 22 attached to the upper end of slider 9.

The lower part of the bore in the housing, with diameter D, contains ring 23 whose inside diameter is equal to d, which ring can slide in the bore of the housing with diameter D between shoulder $F_1$ and locking clip 25 and whose upper part forms truncated cone 24.

The device further comprises gear 26 rigidly attached to the housing which can make the device, and consequently the hollow body, rotate around its axis in the subsequent treatment area.

The operation of the device will now be described with reference to FIGS. 2, 3, and 4 which show the positions of the various components at different times.

At the loading station an exterior mechanism, for example a pusher mounted on a strong spring on an articulated link chain which follows the forward motion of the grasping devices, exerts a predetermined force P, for instance one which is greater than 15 kg, on the upper end of rod 5. This rod moves downwards, compresses spring 13, and by means of shoulder $F_2$ pushes downward slider 9 as well as the segments of crown 16 whose finger 18 is engaged in groove 20.

When they come to the bore with diameter D, the segments of crown 16, which are pushed by ring 21 as a result of the pressure exerted by spring 22, slide on the inclined sides of slider 9 and make contact with the internal surface of bore D. Finger 18 releases the groove in rod 5. The two arms enter the hollow body.

After making a stroke of e.g. 85 millimeters the down-movement of rod 5 is now being stopped by the presence of the object to be grasped which makes contact with the lower face 27 of slider 9. At this instant, crown 16 is in bore D of the housing.

When the action of the external pusher on rod 5 ends, the latter moves upwards again as a result of the force exerted by spring 13, moving the assembly several millimeters. Crown 16 is now blocked by shoulder $F_1$ and it stops slider 9 and arms 11*a* and 11*b*. When it moves upwards, rod 5 spreads by means of its sides 8*a* and 8*b* the two arms 11*a* and 11*b* which pivot on shafts 10*a* and 10*b* and make contact with the inner walls of the hollow object. The hollow body is grasped and carried into the area of the subsequent treatment with the action of the arms being constantly maintained during the entire treatment.

At the discharge station another pusher pushes against rod 5 which causes a complete stroke, for example of 100 mm, as no resistance is opposed to its downward movement because the conveyor receiving the hollow body is located at a distance from the housing, which is greater by, for instance, 3 cm than that which separated the housing from the conveyor at the loading station. The two arms 11*a* and 11*b* close again and release the hollow body and slider 9 completely enters the bore with diameter d of ring 23. The segments of crown 16 slide on the conical section of ring 23 and are engaged inside while still exerting a force directed toward the outside against its walls, due to the action of spring 22 and the conical sides 15 of slider 9. At the same time, finger 18 again engages groove 20 of rod 5 and locks it again.

After the action of the pusher on rod 5 is ended, spring 13 pushes it upwards together with ring 23 and the elements which it contains. The top of ring 23 makes contact with shoulder $F_1$ and crown 16, slider 9 and ring 21 continue their upwards movement in the bore with diameter d until they come to a stop in the upper part of said bore. The clamp has returned to its original position and has completely disappeared in the housing. Ring 23 is released from the action of the segments of the crown and returns to its initial low position.

If no objects are present at the loading station, the downward movement of the rod is no longer limited by the object to be grasped and the rod completes its stroke. The movement starts as in the case where an object is present and it continues as in the case of unloading, i.e. the segments of crown 16 slide on the conical section of ring 23 and are arranged there while they make contact with its walls, finger 18 again engages grooves 20 of rod 5 and locks it and after the action of the pusher has ended, rod 5, pushed by the spring, moves upwards again taking the assembly with it which disappears in the housing.

Finally, after leaving the loading station, if there are no objects present, the clamp has returned to its original position, completely hidden in the housing. When the device arrives at the treatment area the product which is projected, for instance by an atomizing nozzle, does not reach and contaminate the entering mechanism.

FIGS. 5 and 6 show a modification of the grasping device in which the arms are replaced by an extensible sleeve formed by three segments.

The device is the same design as the device described above and comprises to a large extent the same parts, i.e. housing 1 with bores D and d in which slide slider 9, crown 16 with three segments, ring 21, spring 22, and ring 23.

In this modification, rod 5 is equipped with a shaft 101 which is screwed to it and which ends in double cone 102. Ring 103, ending in cone shape 104, slides freely on shaft 101.

Sleeve 105 formed by three segments 106, 107, 108, as shown in FIGS. 7 and 8, is located between cone 102 and ring 103.

These three segments are held together by three extension springs 109, assembled in the shape of a crown, which engage three grooves 110.

The sleeve material can be a metal or a plastic material, such as polyimide. It must be able to withstand a temperature of the order of magnitude of 250° C. for the coating of containers with plastic, for example.

This modification functions in the same manner as the one described before.

As a result of the action of an external pusher, rod 5 moves downwards carrying along all elements inside the housing, as described above, and sleeve 105 enters into the hollow body. At the instant when bottom face 111 of slider 9 makes contact with the hollow body to be grasped, crown 16 is located in bore D of the housing.

When the action P exerted by the pusher on rod 5 ends the latter moves upwards and carries along shaft 101 whose cone 102 spreads from below the three sleeve segments which are spread simultaneously from the top by conical part 104 of ring 103 and locked in place by slider 9 which in turn is locked in place by crown 16. When they are spread, the three segments of the sleeve are applied firmly against the inner wall of the hollow body which is to be grasped.

What is claimed:

1. A device for grasping hollow bodies comprising:

a housing, a mechanism capable of movement into said housing and out of said housing, said mechanism further comprising means for contacting said hollow body and grasping means capable of acting on an interior wall of said hollow body, means for limiting the extent of the outward movement of said mechanism, means which actuate the grasping means to secure said mechanism to said hollow body and to prevent said mechanism from returning into said housing when said mechanism contacts said hollow body on an outward movement before reaching the full extent of such movement as determined by said limiting means, and means which return said mechanism into said housing if said mechanism is moved outward beyond the point at which said grasping means can be actuated when said mechanism contacts said hollow body.

2. Device according to claim 1, characterized in that the entering mechanism comprises the end of a rod, with at least two arms mounted on said end, which arms can be spread in order to make contact with the internal wall of the hollow body.

3. Device according to claim 2, characterized in that the arms are articulated on a shaft.

4. A grasping device comprising:

a rod, a slider, means for clamping an object, a housing which can completely conceal said rod, slider, and clamping means, with the rod and the slider being able to slide inside the housing so that they can emerge from or reenter said housing, means for alternately locking the slider to the rod or the housing, depending on the position of the slider and the rod in relation to the housing, with the slider being locked to the rod at the start and the end of the outward stroke of the rod, while it is locked to the housing in an intermediate position, with the clamping means being actuated in case of a relative movement of the rod against the slider, means which, when the rod reaches the end of an outward stroke from said housing, lock the slider and the rod to each other during the entire return stroke into the housing, and means which tend to return the rod and the slider into the housing at all times.

5. Device according to claim 4, characterized in that the means which lock the slider alternately to the rod and the housing comprise a finger mounted on the slider which due to the action of a spring makes contact alternately with the rod and the housing.

6. A grasping device according to claim 4 or claim 5, wherein:

said clamping means comprises at least two arms, said housing (1) has bores with diameters d and D, where D is greater than d, said slider (9) has an outside diameter d, can slide in the housing and carries the arms of said clamping means, said rod (5) is equipped with inclined sides capable of spreading the arms, said locking means comprises a crown (16) formed of several segments, one of which is equipped with a finger (18) capable of locking said rod (5) and slider (9) together, whereby the rod and the slider are locked together when the segments of the crown are in the bore with diameter d while unlocking takes place when said segments are in the bore with the larger diameter D, said means for locking the slider and the rod when the rod reaches the end of an outward stroke comprises a ring (23) which is movable in bore D and whose inside diameter is equal to d, and said return means comprises a return spring (13) which tends to make the end of rod (5) and the arms disappear in the housing.

7. Device according to one of the claims 4 or 5, characterized in that the clamping means comprise a sleeve (105) formed by at least two segments held together by at least one spring with said sleeve being held between a conical surface of a shaft (101) rigidly attached to the end of said rod (5) and a ring (103) with a conical surface which is mounted slidingly around said shaft (101).

8. Apparatus for grasping an object comprising:

a hollow housing having at least one opening therethrough;

a rod which can be moved back and forth between a first position within said housing and a second position;

a structure which is adapted to contact said object and which can be selectively coupled to said rod for movement therewith, said structure being movable by said rod from a first position in which it is within said housing to a second position in which it extends through said opening and contacts the object;

means for grasping said object, said grasping means being movable by said rod from a first position in which it is within said housing to a second position in which it grasps said object, at least said grasping means, said rod and said structure interacting to cause said grasping means to grasp said object;

means which secure the structure to the rod when the structure is in the vicinity of its first position and which release the structure from the rod when the structure is moved by the rod so that it is in or near contact with the object; and means for resecuring said structure to the rod so that the structure is drawn back into the housing when the rod is moved toward its first position.

9. Apparatus according to claim 8 wherein:

said rod is spring-biased to remain in a first position in which said structure is secured to said rod;

said structure is moved into contact with said object on an outward stroke of said rod from its first position by a force applied to said rod against its spring-bias; and said structure is released from said rod before the outward stroke of said rod ceases and either is prevented from moving back with said rod on its return stroke if said structure contacts said object or is resecured to said rod before said outward stroke ceases if said structure does not contact said object.

10. Apparatus according to claim 8 wherein said housing contains first and second bores, said first bore being adjacent said opening in said housing and having a larger diameter than said second bore, and said means which secure and release comprises a spring-biased movable member mounted on a sloping surface connected to said structure, the movement of said movable member being constrained by the inner wall of said housing, said structure being secured to said rod when said movable member is within said second bore and said structure being released from said rod when the structure is moved so that said movable member is within said larger diameter first bore.

11. Apparatus according to claim 10 wherein said resecuring means comprises:

a sleeve which is mounted within said first bore and has an inner diameter that is substantially the same as that of said second bore; and means for moving said movable member onto said sleeve when said rod is near the end of an outward stroke from its first position, whereby said member is moved to a position in which said structure is resecured to said rod.

12. Apparatus according to any one of claims 8 through 11 wherein said grasping means comprises at least two arms mounted on said structure which are forced by the rod into grasping relationship with the object upon movement of the rod relative to the structure after the structure is released from the rod.

13. Apparatus according to claim 8 wherein said means which secure and release and said resecuring means cooperate to lock said structure to said rod both during the return stroke of said rod to its first position and at the start of an outward stroke of the rod from its first position.

14. Apparatus for grasping a bottle from the inside of its neck comprising:

a tubular housing having at least one opening therethrough which may be aligned with an opening in the neck of the bottle;

a rod which can be moved back and forth between a first position within said housing and a second position;

a structure which is adapted to contact the rim around the opening in the neck of the bottle and which can be selectively coupled to said rod for movement therewith, said structure being movable by said rod from a first position in which it is within said housing to a second position in which it extends through said opening and contacts the rim of the bottle;

means for grasping the bottle from the inside of its neck, said grasping means being movable by said rod from a first position in which it is within said housing to a second position in which it extends into the neck of the bottle;

means for locking said structure to said rod during the return stroke of the rod to its first position and at the start of an outward stroke of the rod from its first position and for releasing said structure from the rod during its outward stroke; and means for actuating the grasping means to grasp said bottle upon movement of said structure and said rod relative to one another.

15. Apparatus according 14 wherein:

said rod is spring-biased to remain in a first position in which said structure is secured to said rod;

said structure is moved into contact with the rim of said bottle on an outward stroke of said rod by a force applied to said rod against its spring-bias; and said structure is released from said rod before the outward stroke of said rod ceases and either is prevented from moving back with said rod on its return stroke if said structure contacts said bottle or is resecured to said rod before said outward stroke ceases if said structure does not contact said bottle.

16. Apparatus according to claim 15 wherein:

said housing contains first and second bores, said first bore being adjacent the open end of said housing and having a larger diameter than said second bore; and said locking and releasing means comprises a spring-biased movable member mounted on a sloping surface connected to said structure, the movement of said movable member being constrained by the inner wall of said housing, said structure being secured to said rod when said movable member is within said second bore and said structure being released from said rod when the structure is moved so that the movable member is within said larger diameter first bore.

17. Apparatus according to claim 16 further comprising:

a sleeve which is mounted within said first bore and has an inner diameter that is substantially the same as that of said second bore; and means for moving said movable member onto said sleeve when said rod is near the end of an outward stroke from its first position, whereby said movable member is moved to a position in which said structure is resecured to said rod.

18. Apparatus according to anyone of claims 14 through 17 wherein said grasping means comprises at least two arms mounted on said structure which are forced by the rod into grasping relationship with the bottle when the rod moves back towards its first position after the structure is released from the rod.

19. Apparatus according to claim 8 or claim 14 further comprising:

means for spring-biasing said rod to remain in a first position in which said structure is secured to said rod; and means for moving said structure into contact with said object on an outward stroke of said rod from its first position by a force applied to said rod against its spring-bias.

20. A grasping device according to claim 4 wherein:

said housing contains first and second bores, said first bore being adjacent an open end of said housing and having a larger diameter than said second bore, and said alternately locking means comprises a spring-biased movable member mounted on a sloping surface connected to said slider, the movement of said movable member being constrained by the inner wall of said housing, said slider being secured to said rod when said movable member is within said second bore, said slider being released from said rod when the slider is moved so that the movable member is within said larger diameter first bore, and said movable member preventing the slider from returning into said housing while said movable member is in contact with the inner wall of said first bore, said clamping means being actuated upon relative movement between said rod and said slider.

21. A grasping device according to claim 4 wherein:

said clamping means comprises at least two arms, said housing has bores with diameters d and D, where D is greater than d, said slider has an outside diameter d, can slide in the housing and carries the arms of said clamping means, said rod is equipped with inclined sides capable of spreading the arms when there is relative movement between said slider and said rod, said alternately locking means comprises a sloping surface on said slider and a movable member that is adapted to ride on said sloping surface and is spring biased in the direction of movement of said slider, the transverse movement of said movable member being constrained by the inner wall of said housing, said movable member being equipped with a finger that locks said rod and slider together only when said movable member is in one region on said sloping surface, whereby the rod and the slider are locked together when the sloping surface on said slider is in the bore with diameter d while unlocking takes place when said sloping surface is in the bore with the larger diameter D, said means for locking the slider and rod when the rod reaches the end of an outward stroke comprise a ring which is movable in bore D and whose inside diameter is equal to d, means for limiting the outward movement of said ring, and a sloping surface on said ring adapted to engage said movable member, whereby when said ring is stopped by said limiting means said movable member can be moved to a position on the inside of said ring in which said finger locks the rod and the slider for their return into the housing, and said return means comprises a return spring which tends to make the end of the rod and the arms disappear in the housing.

22. Apparatus for grasping an object according to claim 8 wherein:

said housing contains first and second bores, said first bore being adjacent an open end of said housing and having a larger diameter than said second bore, and said means which secure and release the movable structure comprises a spring-biased movable member mounted on a sloping surface connected to said movable structure, the movement of said movable member being constrained by the inner wall of said housing, said movable structure being secured to said rod when said movable member is within said second bore, said movable structure being released from said rod when the movable structure is moved so that the movable member is within said larger diameter first bore, and said movable member preventing the movable structure from returning into said housing while said movable member is in contact with the inner wall of said first bore, said grasping means being actuated upon relative movement between said connecting rod and said movable structure.

23. Apparatus for grasping an object according to claim 8 wherein:

said grasping means comprises at least two arms, said housing has bores with diameters d and D, where D is greater than d, said movable structure has an outside diameter d, can slide in the housing and carries the arms of said grasping means, said rod is equipped with inclined sides capable of spreading the arms when there is relative movement between said movable structure and said rod, said means which secure and release the structure comprises a sloping surface on said movable structure and a movable member that is adapted to ride on said sloping surface and is spring biased in the direction of movement of said movable structure, the transverse movement of said movable member being constrained by the inner wall of said housing, said movable member being equipped with a finger that locks said rod and movable structure together only when said movable member is in one region on said sloping surface, whereby the rod and the movable structure are locked together when the sloping surface on said movable structure is in the bore with diameter d while unlocking takes place when said sloping surface is in the bore with the larger diameter D, and said resecuring means comprises a ring which is movable in bore D and whose inside diameter is equal to d, means for limiting the outward movement of said ring, and a sloping surface on said ring adapted to engage said movable member, whereby when said ring is stopped by said limiting means said movable member can be moved to a position on the inside of said ring in which said finger locks the rod and the movable structure for their return into the housing.

24. Apparatus for grasping a bottle according to claim 14 wherein:

said housing contains first and second bores, said first bore being adjacent an open end of said housing and having a larger diameter than said second bore, said locking and releasing means comprises a spring-biased movable member mounted on a sloping surface connected to said movable structure, the movement of said movable structure being constrained by the inner wall of said housing, said movable structure being secured to said rod when said movable member is within said second bore, said movable structure being released from said rod when the movable structure is moved so that the movable member is within said larger diameter first bore, and said movable member preventing the movable structure from returning into said housing while said movable member is in contact with the inner wall of said first bore, said grasping means being actuated upon relative movement between said rod and said movable structure.

25. Apparatus for grasping a bottle according to claim 14 wherein:

said grasping means comprises at least two arms, said housing has bores with diameters d and D, where D is greater than d, said movable structure has an outside diameter d, can slide in the housing and carries the arms of said grasping means, said actuating means comprises at least one inclined surface on said rod capable of spreading the arms when there is relative movement between said movable structure and said rod, said locking and releasing means comprises: a sloping surface on said movable structure; a movable member that is adapted to ride on said sloping surface and is spring biased in the direction of movement of said slider, the transverse movement of said movable member being constrained by the inner wall of said housing, said movable member being equipped with a finger that locks said rod and movable structure together only when said movable member is in one region on said sloping surface; a ring which is movable in bore D and whose inside diameter is equal to d; means for limiting the outward movement of said ring; and a sloping surface on said ring adapted to engage said movable member, whereby the rod and the movable structure are locked together when the sloping surface on said movable structure is in the bore with diameter d, unlocking takes place when said sloping surface moves into the bore with the larger diameter D, and when said ring is stopped by said limiting means said movable member can be moved to a position on the inside of said ring in which said finger locks the rod and the movable structure for their return into the housing.

26. Apparatus according to claim 1 wherein:

said housing contains first and second bores, said first bore being adjacent the open end of said housing and having a larger diameter than said second bore, said limiting means and said return means comprise a spring, a connecting element against which said spring bears, said connecting element being selectively connectable to said mechanism, and means for resecuring said mechanism to said connecting element, said grasping means being actuated upon relative movement between said connecting element and said mechanism, and said means which actuate the grasping means and prevent said mechanism from returning into said housing comprises a spring-biased movable member mounted on a sloping surface connected to said mechanism, the movement of said movable member being constrained by the inner wall of said housing, said mechanism being secured to said connecting element when said movable member is within said second bore, said mechanism being released from said connecting element when the mechanism is moved so that the movable member is within said larger diameter first bore, and said movable member preventing the mechanism from returning into said housing while said movable member is in contact with the inner wall of said first bore.

27. Apparatus according to claim 26 wherein said return means further comprises:

a sleeve which is mounted within said first bore and has an inner diameter that is substantially the same as that of said second bore; and means for moving said movable member onto said sleeve when said mechanism is near the full extent of an outward movement from said housing, whereby said movable member is moved to a position in which said mechanism is resecured to said connecting element.

28. Apparatus according to claim 26 wherein said grasping means comprises at least two arms mounted on said mechanism which are forced by said connecting element into grasping relationship with the hollow body when the connecting element moves back toward said housing after the mechanism is released from the connecting element.

29. Apparatus according to claim 1 wherein:

said grasping means comprises at least two arms, said housing has bores with diameters d and D, where D is greater than d, said movable mechanism has an outside diameter d, may be selectively connected to a rod can slide in the housing and carries the arms of said grasping means, said means which actuate the grasping means and prevent said mechanism from returning into said housing comprises a sloping surface on said movable mechanism and a movable member that is adapted to ride on said sloping surface and is spring biased in the direction of movement of said mechanism, the transverse movement of said movable member being constrained by the inner wall of said housing, said movable member being equipped with a finger that locks said rod and movable mechanism together only when said movable member is in one region on said sloping surface, whereby the rod and the movable mechanism are locked together when the sloping surface on said movable mechanism is in the bore with diameter d, unlocking takes place when said sloping surface is in the bore with the larger diameter D, and the movable member prevents the mechanism from returning into said housing while said movable member is in contact with the inner wall of the bore of diameter D, and said limiting means and said return means comprise: said rod that may be selectively connected to said mechanism; a return spring that tends to make said rod disappear into said housing, said rod bearing a means capable of spreading the arms of said grasping means if there is relative movement between said rod and said arms; a ring which is movable in bore D and whose inside diameter is equal to d; means for limiting the outward movement of said ring; and a sloping surface on said ring adapted to engage said movable member, whereby when said ring is stopped by said limiting means said movable member can be moved to a position on the inside of said ring in which said finger locks the rod and the movable mechanism for their return into the housing.

30. Apparatus according to claim 1 wherein:

said limiting means and return means comprise a connecting element which may be selectively connected to said mechanism; and said grasping means comprises at least one wedge shaped element which may be thrust into grasping relationship with said interior wall of the hollow body upon relative movement between said connecting element and said mechanism.

31. Apparatus according to claim 1 wherein:

said limiting means and said return means comprise a rod which may be selectively connected to said mechanism, said rod bearing at least one sloping surface; and said grasping means comprises a spring-biased element adapted to ride on the sloping surface of said rod, said element being thrust into grasping relationship with said interior wall of the hollow body upon relative movement between said rod and said mechanism.

32. Apparatus according to claim 31 wherein the sloping surface of said rod is conical in shape and the spring-biased element is a plurality of wedge-shaped elements disposed about the circumference of the rod in contact with said conical surface and secured in place by at least one spring that extends around said rod.

* * * * *